US006704948B2

(12) United States Patent
Shirkey

(10) Patent No.: US 6,704,948 B2
(45) Date of Patent: Mar. 16, 2004

(54) SELF-SUPPORTING DISPOSABLE WASTE CONTAINER

(76) Inventor: Melissa Ann Shirkey, 109 19th St., Dunbar, WV (US) 25064

( * ) Notice: Subject to any disclaimer, the term of this patent is extended or adjusted under 35 U.S.C. 154(b) by 0 days.

(21) Appl. No.: 10/163,037

(22) Filed: Jun. 4, 2002

(65) Prior Publication Data

US 2003/0221249 A1 Dec. 4, 2003

(51) Int. Cl.[7] ..... A47K 11/04

(52) U.S. Cl. ..... 4/479; 4/144.2; 4/484; 4/902

(58) Field of Search ..... 4/483, 484, 479, 4/450–453, 456, 457, 144.1, 144.2, 902

(56) References Cited

U.S. PATENT DOCUMENTS

| | | | | | |
|---|---|---|---|---|---|
| 1,510,061 | A | * | 9/1924 | Jones | 4/483 |
| 3,475,767 | A | * | 11/1969 | Friesen et al. | 4/452 |
| 3,591,870 | A | * | 7/1971 | Friesen | 4/144.2 |
| 3,613,123 | A | * | 10/1971 | Langstrom | 4/144.3 |
| 3,683,426 | A | * | 8/1972 | Lagstrom | 4/484 |
| 3,713,178 | A | * | 1/1973 | Mallette | 4/451 |
| 3,936,890 | A | | 2/1976 | Oberstein | |
| 4,011,606 | A | | 3/1977 | Scrafield et al. | |
| 4,343,053 | A | | 8/1982 | O'Connor | |
| 4,720,880 | A | | 1/1988 | Barreau | |
| 4,759,086 | A | | 7/1988 | Booth-Cox | |
| 4,882,794 | A | | 11/1989 | Stewart, III | |
| 5,611,092 | A | | 3/1997 | Van Dusen | |
| 5,778,458 | A | | 7/1998 | Speelman | |
| 6,070,277 | A | * | 6/2000 | Thomas | 4/484 |
| 6,115,855 | A | * | 9/2000 | Lorenzo | 4/484 |

* cited by examiner

*Primary Examiner*—Michael Mar
*Assistant Examiner*—Huyen Le
(74) *Attorney, Agent, or Firm*—Merchant & Gould, P.C.

(57) ABSTRACT

A disposable waste container that includes a housing defining a reservoir within the housing and where the housing is adaptable for receiving bodily waste. The housing includes a plurality of layers, where the layers include at least an inner layer and an outer layer and at least one intermediate layer between the inner and outer layers. The housing defines a self-supportable structure, wherein the self-supportable structure is defined by at least one of the layers having a semi-rigid structure to enable self-supporting of the housing.

13 Claims, 5 Drawing Sheets

10
24
22
20
12
12a
20
18
26
16
14

10
22
24
26
20

SELF-SUPPORTING DISPOSABLE WASTE CONTAINER

FIELD OF INVENTION

The present invention relates generally to a waste container for holding and disposing bodily waste. More particularly, the present invention relates to a waste container that is self-supporting.

BACKGROUND OF THE INVENTION

A variety of toilet seats and bedpans employing containers are widely used. Such containers must be cleaned after use. The need to clean such containers is unpleasant and may facilitate the spread of contaminants from such an unsanitary environment.

Further developments of such toilet seats have employed disposable liners or receptacles that reside within a toilet seat or bedpan. Typically, these disposable liners or receptacles are formed of a collapsible structure that conforms to the container or basin of the toilet seat itself. Examples of existing liners are discussed below.

U.S. Pat. No. 4,882,794 to Stewart, III discloses a disposable waste containment unit being a bag with a liquid impermeable bag layer having an absorbent element therein. A gathering means, such as tape, is disposed at an upper rim of the bag. The bag is a collapsible unit that conforms to the container it is inserted into.

U.S. Pat. No. 4,720,880 to Barreau discloses a protective lining for toilets provided with seats. The lining includes a bag that adopts the shape of a toilet basin and a flange for engaging the seat to connect the bag thereto.

U.S. Pat. No. 5,778,458 to Speelman discloses a biodegradable and flushable bedpan liner. The liner is made of a paper material cut and sized to fit the size of a bedpan. The liner rests in the pan when in use. The liner is disposed of after use by tilting the bedpan such that the liner slides or is dumped out of the bedpan into a toilet and flushed for disposal.

U.S. Pat. No. 4,759,086 to Booth-Cox discloses a disposable receptacle for bodily waste. The receptacle includes an inner fluid permeable layer and an impermeable outer layer where an absorbent layer is disposed between the inner and outer layer. Further, the receptacle includes a rim portion with fastening means to attach the receptacle to a bedpan support or toilet trainer such that the receptacle depends downward when attached.

Such devices, as above, rely on particular gatherings, snaps, strings, tape, tabs or adhesive to attach a liner to a support structure, such as a bedpan or toilet seat. These devices do not allow for a self-supporting disposable waste container, and often employ a flexible construction that may not be effective for containing the bodily waste in the liner on their own. Although these devices may be suitable for their intended uses, improvements may still be made in providing a disposable waste container that can be used in place of a lavatory system or incorporated with an existing lavatory system, such as a bedpan, toilet trainer, toddler toilet seat, etc, while maintaining optimum convenience for disposing the waste container and at least reducing if not eliminating the need to clean the toilet basin and pans of such lavatory systems. In addition, it is of importance to provide a disposable waste container that is self-supporting. Further, there is a need for a disposable waste container that is easy to manufacture and that is cost efficient.

SUMMARY OF THE INVENTION

In accordance with the present invention, improvements upon existing designs for disposing bodily waste have been made by providing a disposable waste container with a self-supporting structure enabling the disposable waste container to remain in an upright position.

In one embodiment of the present invention, a disposable waste container includes a housing with a top, a bottom and a sidewall that define a reservoir within the housing. The top defines an open side adaptable for receiving waste. The housing includes a plurality of adjacent layers, where the layers define at least an inner layer and an outer layer and at least one intermediate layer disposed between the inner and outer layers. The housing includes a self-supportable structure, where the self-supportable structure includes at least one of the layers being a semi-rigid layer so as to enable self-supporting of the housing.

In one embodiment of the present invention, the self-supportable structure enables the sidewall of the housing to remain in an upright position.

In one embodiment of the present invention, the housing is adaptable for use with existing lavatory systems or for use of disposing waste on its own. Preferably, the housing is disposable after one time use.

In one embodiment of the present invention, the inner layer includes a permeable structure, where the permeable structure is arranged and configured to enable bodily waste to pass through the inner layer from the reservoir. Preferably, the permeable structure is a porous material. More preferably, liquid waste is enabled to pass through the inner layer to the intermediate layer, while solid waste is retained and supported in the reservoir of the disposable waste container.

In one embodiment of the present invention, the outer layer includes an impermeable structure, where the impermeable structure is arranged and configured to prevent bodily waste from passing through the housing and into an outer environment. Preferably, the impermeable structure is a plastic material.

In one embodiment of the present invention, an intermediate layer includes an absorbent material, where the absorbent material is arranged and configured to enable support of liquid bodily waste absorbed into the absorbent material.

Preferably, the absorbent material is a semi-rigid structure providing the semi-rigid layer enabling self-supporting of the disposable waste container.

In one embodiment of the present invention, the housing includes a tape tab disposed on the outer layer proximate the top of the housing. The tape tab enables closing of the open side for disposal of the waste container after usage. Preferably, the tape tab resides about at least a portion of the perimeter of the housing along the outer layer, so that the sidewall of the housing may be pushed inward at oppositely disposed positions to close the open side. More preferably, the tape tab connects with an opposite portion thereof to close the open side of the housing for disposal of the waste container.

In one embodiment of the present invention, the housing may be arranged and configured such that a plurality of said housings are nestable into a stacked arrangement.

The present invention provides a disposable waste container that allows for easy placement into an existing lavatory system, such as a training or a portable toilet and toilet seat or a bedpan, and allows for easy and hygienic removal of bodily waste from such existing lavatory systems. The present invention reduces the need to clean the toilet or bedpan after use. Further, the present invention can be used as a stand-alone unit without the need for a structure that connects to such a toilet seat or bedpan for support. The disposable waste container provides a self-supportable structure where a sidewall of the housing is arranged and configured to prevent collapse of the disposable waste container and enable the disposable waste container to remain in an upright position on its own. The semi-rigidity of the housing structure provides convenience for disposal rather than the flexible and collapsible construction of existing designs. Preferably, solid waste collected in the reservoir of the disposable waste container may be dumped in a flushable toilet, while the disposable waste container supporting absorbed liquid waste can be but is not limited to disposal in a plastic garbage bag or diaper disposal bag. In addition, such a structure for a disposable waste container eliminates the need to rely on secondary or additional support structures for attachment to a toilet seat or bedpan, such as gatherings, snaps, strings, tabs, flanges or adhesives. Furthermore, a plurality of disposable waste containers, having a housing as structured above, may be nestable into a stacked configuration for easy packaging and storage.

A variety of additional advantages and objects of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

Referring now to the drawings in which like reference numbers represent corresponding parts throughout.

DETAILED DESCRIPTION OF THE PREFERRED EMBODIMENTS

In the following description of the illustrated embodiments, reference is made to the accompanying drawings that form a part hereof, and in which is shown by way of illustration of the embodiments in which the invention may be practiced. It is to be understood that other embodiments may be utilized as structural changes may be made without departing from the spirit and scope of the present invention.

Figure 1:
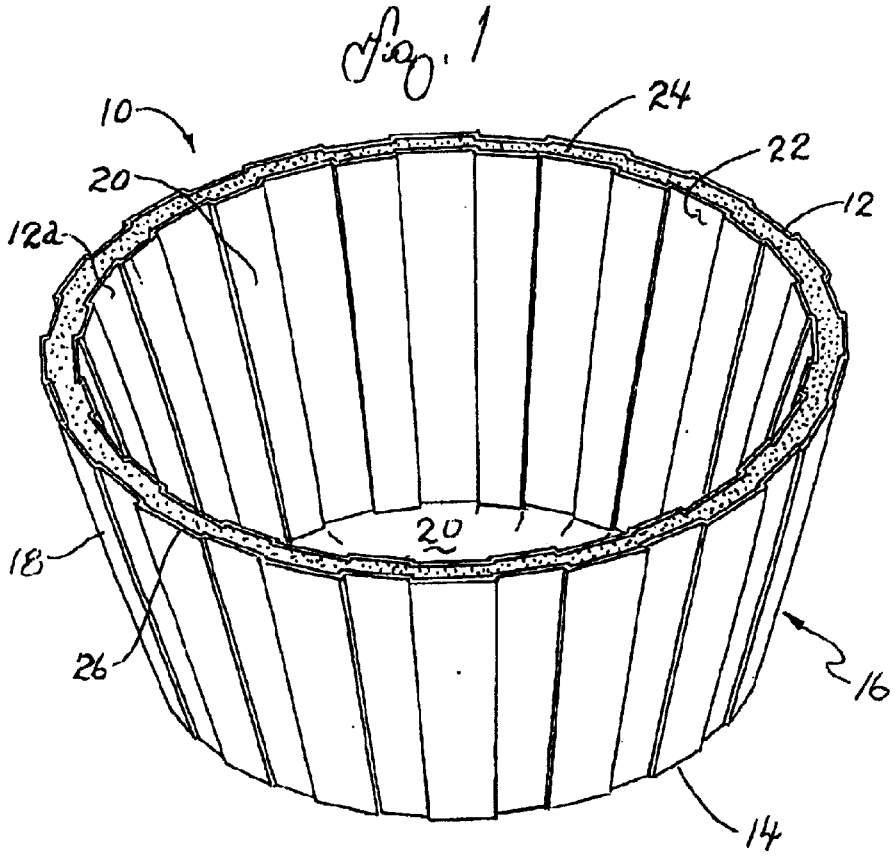
FIG. 1 represents a top perspective view of one embodiment for a disposable waste container in accordance with the principles of the present invention.
Figure 2:
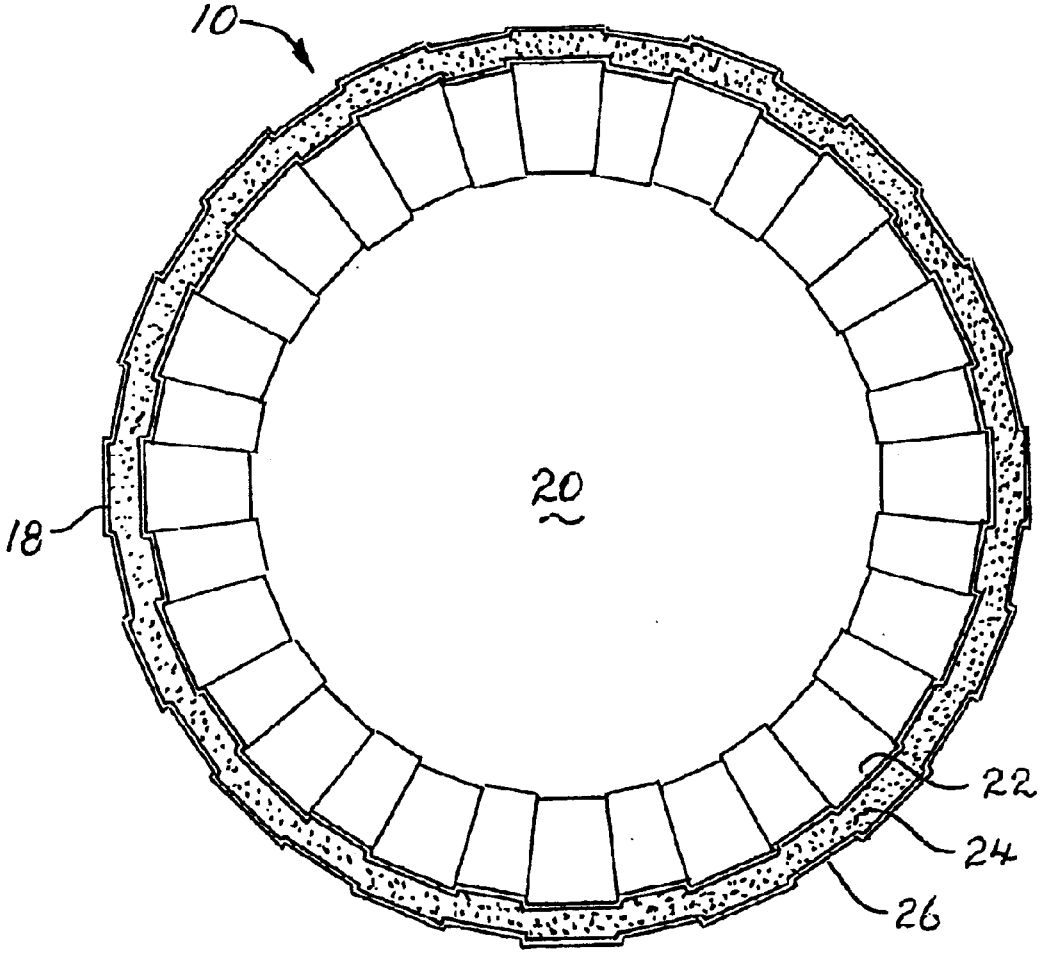
FIG. 2 represents a top view of the disposable waste container of FIG. 1.
Figure 3:
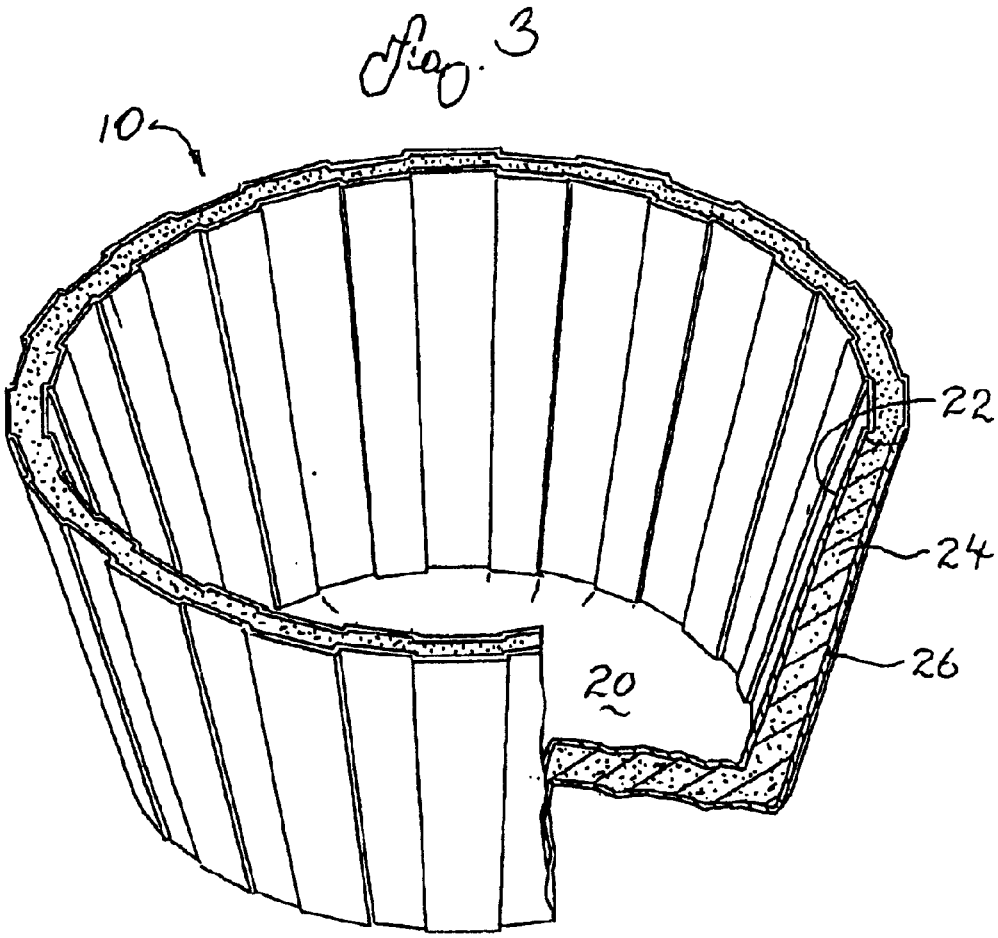
FIG. 3 represents a partial sectional view of the disposable waste container of FIG. 1.

FIGS. 1–3 illustrate one preferred embodiment of a disposable waste container 10 in accordance with the principles of the present invention. FIG. 1 shows a top perspective view of the disposable waste container 10. The disposable waste container 10 is shown in an upright position. The disposable waste container 10 includes housing 18 having a top 12 and a bottom 14. A sidewall 16 is formed between the top 12 and the bottom 14. The top 12, bottom 14 and sidewall 16 define a reservoir 20 within the housing 18. The top 12 defines an open side 12*a* that is adaptable for receiving waste, for instance bodily waste voided by a person. Preferably, the disposable waste container 10 is used for receiving and disposing of bodily waste. More preferably, the disposable waste container 10 may be disposable after one time use. Solid waste collected in the reservoir of the disposable waste container may be dumped in a flushable toilet, while the disposable waste container supporting absorbed liquid waste can be but is not limited to disposal in a plastic garbage bag or diaper disposal bag. It will be appreciated that the disposable waste container 10 may be employed for other waste containment and disposal applications.

As best shown in FIGS. 2 and 3 that show respective top and partial sectional views of the disposable waste container 10, the housing 18 includes a plurality of layers. Preferably, the layers are adjacently connected to form an integrally shaped housing being a one piece unit, such as housing 18. The plurality of layers provides a structure suitable for supporting bodily waste collected therein. At least one layer is an inner layer 22 and at least one layer is an outer layer 26. At least one intermediate layer 24 is disposed between the inner and outer layers 22, 26. Preferably, the housing 18 is a self-supportable structure enabling the housing 18 to stand on its own without any need for additional support structures. Particularly, the sidewall 16 remains in an upright position (FIG. 1). More preferably, at least one of the layers 22, 24, 26 is a semi-rigid layer so as to enable the housing 18 to be self-supporting.

The inner layer 22 faces the reservoir 20 and is the first of the layers to contact received waste along the sidewall 16 and bottom 14 of the housing 18. Preferably, the inner layer 22 includes a permeable structure, and is arranged and configured so as to enable liquid waste to pass through the inner layer 22 from the reservoir 20 to the intermediate layer 24. More preferably, the inner layer 22 is constructed of a porous material enabling at least liquid bodily waste to pass through while supporting containment of any solid bodily waste received in the reservoir 20. The material for the inner layer 22 may be, but is not limited to, a plastic web or a mesh, a cloth or fabric material that is permeable to liquids. Further, the material of the inner layer 22 also may be constructed of a material that contacts the skin of a person, and used for infant, toddler, and adult incontinence undergarments.

The outer layer 26 faces outward or toward the outside environment or existing lavatory system the disposable waste container 10 may be incorporated with. Preferably, the inner layer 26 includes an impermeable structure, and is arranged and configured so as to prevent any waste to pass through the housing 18 and escape from the inner layer 22, intermediate layer 24 and reservoir 20 of the disposable waste container 10. More preferably, the outer layer 26 is a durable liquid impermeable material that prevents leakage from the disposable waste container 10. The material for the outer layer 26 may be, but is not limited to, a plastic material.

The intermediate layer 24 resides between the inner and outer layers 22, 26. Preferably, the intermediate layer 24 includes an absorbent material that is arranged and configured to enable support of waste that passes through the inner layer 22. The absorbent material includes a suitable capacity for absorbing waste that passes through the inner layer 22 from the reservoir 20. More preferably, the absorbent material may be a material conventionally used in incontinence undergarments, such as diapers, or may be an absorbent gel or foam. It will be appreciated that materials used for the intermediate layer 24 and the absorbency properties of the intermediate layer 24 may vary as needed. It will be appreciated that a chemical additive may be incorporated within the intermediate layer 24 to mask or neutralize the odor of the waste absorbed into the intermediate layer 24. In addition, the intermediate layer 24 may employ an anti-bacterial additive to kill bacteria associated with the absorbed waste. Such chemical and anti-bacterial additives may be those conventionally used in detergent and cleaning products and other absorbing products such as, but not limited to, diapers.

Preferably, at least one of the inner, intermediate and/or outer layers 22, 24, 26 is a semi-rigid layer so as to enable the housing 18 to be self-supporting. Particularly, the sidewall 16 of the housing 18 is constructed with sufficient rigidity such that the disposable waste container 10 is prevented from collapsing. Preferably, the intermediate layer 24 is constructed of a semi-rigid material along with the absorbency characteristics discussed above to provide the necessary rigidity for the housing 18, while the inner and outer layers 22, 26 are a substantially flexible material. It will be appreciated that the configuration forming the rigidity of the housing 18 may be modified as desired such that the layers forming the housing 18 together form a self-supporting unit. For instance, materials may be employed such that one layer alone or every layer may be a semi-rigid material so as to provide the necessary rigidity for the housing 18. It will also be appreciated that the thickness of each layer may vary as needed.

Further, it will be appreciated that disposable waste container 10 is not limited to a particular size of toilet seat or bedpan and that the semi-rigid structure of the housing 18 may be such that at least some flexibility is provided so as to allow the disposable waste container 10 to be adapted and adjusted to fit a variety of sizes and shapes for a toilet seat or bedpan, and to allow closing of the open side for disposal after usage. Such a structure allows one to dispose of waste in a convenient and sanitary manner, and the disposable waste container 10 may be used as a waste disposal unit on its own.

As shown in FIGS. 1–3, one intermediate layer 24 is disposed between the inner and outer layers 22, 26. It will be appreciated that additional intermediate layers (such as intermediate layer 24) and/or a varying thickness of the intermediate layer 24 may be employed as necessary for the application of the disposable waste container. For example, disposable waste containers employed for multiple uses may need multiple intermediate layers, such as intermediate layer 24, or an increased thickness in the intermediate layer 24 for added capacity in absorbing waste. Such multiple intermediate layers 24 also may employ a retention layer (not shown), which may be formed between each intermediate layer 24 so as to allow entry into each intermediate layer 24 while preventing escape of the absorbed waste from each intermediate layer 24 back towards the direction of the reservoir, such as reservoir 20. A retention layer may be employed such as those used in conventional diapers intended to keep an infant's skin dry after waste is collected or absorbed into the diaper.

Preferably, the disposable waste container 10 is formed as a bucket shaped unit, and is adaptable for use as a liner mounted within existing lavatory systems, such as but not limited to conventional training toilet seats for toddlers and bedpans. It will be appreciated that the disposable waste container 10 is nestable with a plurality of disposable waste containers 10 to facilitate convenient packaging and storage thereof. Further, it will be appreciated that other shapes may be employed for the disposable waste container 10 as needed. More preferably, the disposable waste container 10 may be sized and shaped as needed according to the particular toilet seat, bedpan, or other lavatory systems it is mounted within.

As above, the disposable waste container 10 may be adaptable for use, for instance with existing portable toilet seats, toilet seats for training toddlers or with existing bedpans, etc. Further, the self-supporting, self-standing capability of the disposable waste container provides a unit that also may be used as a stand-alone unit without the need for a toilet seat or bedpan. This application may be suitable for outdoor applications, such as camping, or for any event where a toilet seat or bedpan may not be readily available.

Figure 4:
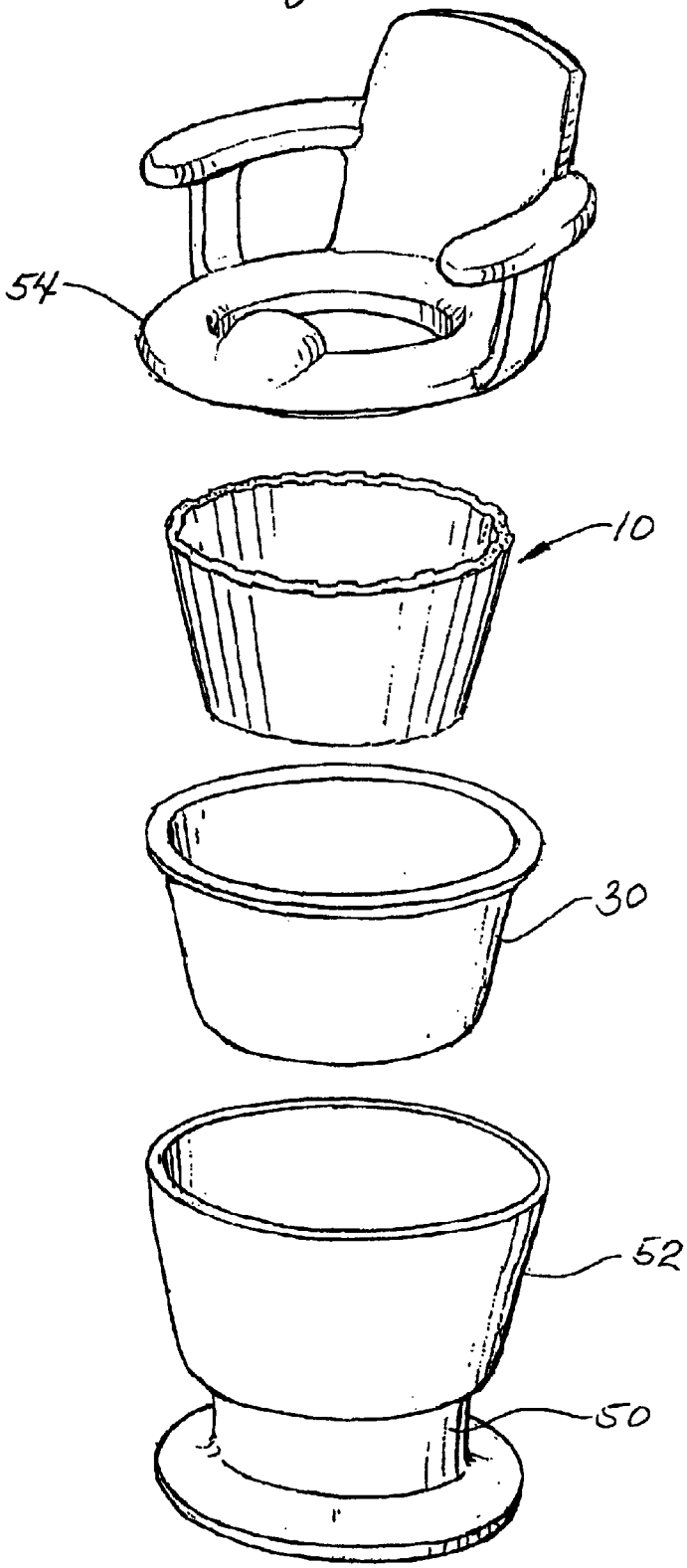
FIG. 4 represents an exploded view of one embodiment of a lavatory system incorporating the disposable waste container of FIG. 1 in accordance with the principles of the present invention.

FIG. 4 illustrates one embodiment of the disposable waste container 10 of the present invention incorporated with an existing lavatory system. The disposable waste container 10 is a component of a lavatory system such as a portable toilet seat 50 for toddlers. The toilet seat 50 may be a conventional toddler toilet seat used for training purposes, and includes a basin 52 constructed to allow entry of bodily waste and a top surface 54 to allow a user to sit on the toilet seat 50. Examples of such existing toilet seats can be found in models produced by Sentry and Safety First. The basin 52 is constructed such that a pan 30 may be housed within the basin 52 to collect bodily waste entering the basin 52. The disposable waste container 10 is insertable into the pan 30 as a liner, such that no waste contacts the pan 30 or the basin 52. The disposable waste container 10 is substantially sized and shaped to fit and line the pan 30, and reduces and/or eliminates the need to clean the pan 30 and toilet seat 50.

Figure 5:
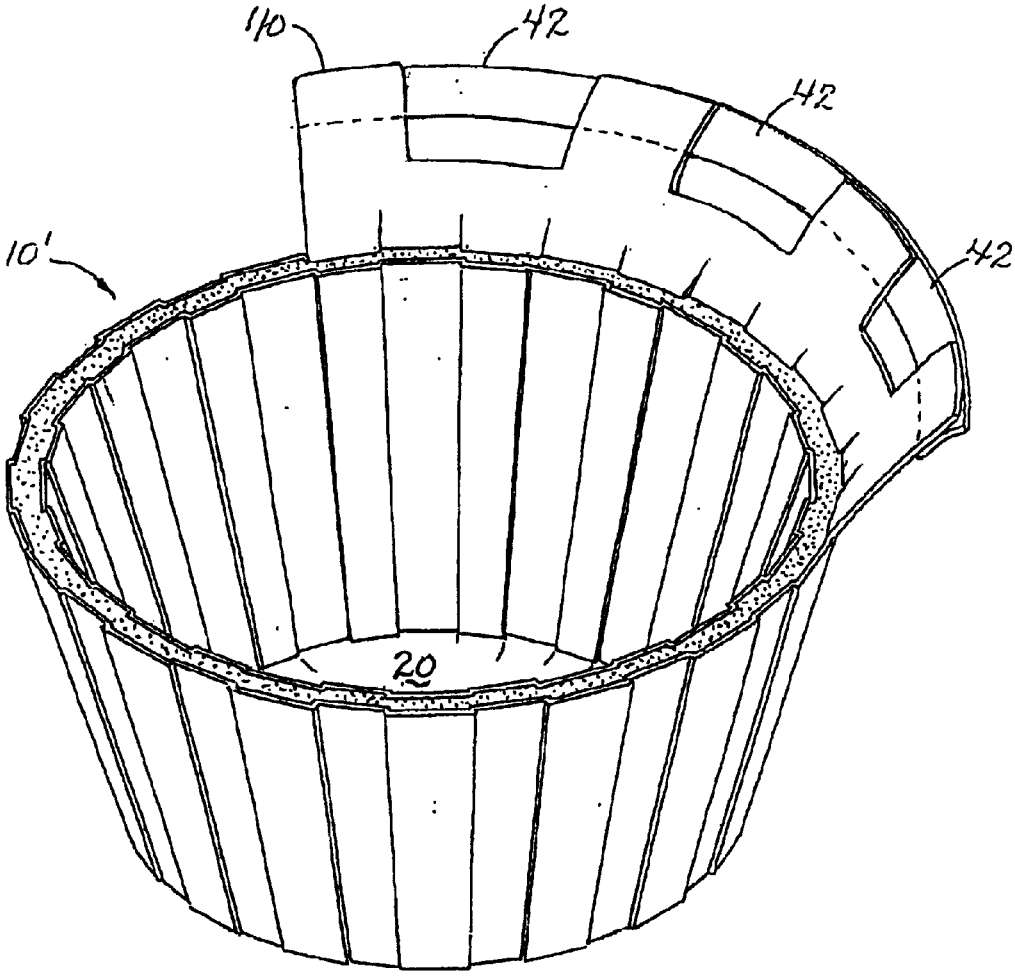
FIG. 5 represents a top perspective view of another embodiment of a disposable waste container in accordance with the principles of the present invention.

FIG. 5 illustrates another embodiment of a disposable waste container 10' including a tape tab 40 connected to the housing. With the exception of the tape tab 40, the features of the disposable waste container 10' are the same as described above for the disposable waste container 10, and are not further discussed. The tape tab 40 is disposed on the outer layer proximate the top of the housing and includes at least one portion 42 disposed on the tape tab 40. The portion 42 includes an adhesive for taping the tape tab to another portion of the housing so as to close the open side of the disposable waste container. The tape tab enables closing of the open side through the adhesive portions 42 for disposal of the waste container after usage. Preferably, the tape tab 40 resides about at least a portion of the perimeter of the housing along the outer layer, so that the sidewall of the housing may be pushed inward at oppositely disposed positions to close the open side. More preferably, the tape tab 40 uses the adhesive portions 42 to connect with an opposite portion thereof to close the open side of the housing for disposal of the waste container.

The invention provides advantages such as a disposable waste container that allows for easy placement into an existing lavatory system, such as a portable toilet and toilet seat, a toddler toilet training seat, or a bedpan, and allows for easy and hygienic removal of bodily waste from such existing lavatory systems. The present invention reduces the need to clean the toilet or bedpan after use and may be disposed of after one time use. Further, the present invention can be used as a stand-alone unit without the need for a support structure usually provided by a toilet seat or bedpan.

The disposable waste container provides a self-supportable structure where a sidewall of the housing is arranged and configured to prevent collapse and enable the disposable waste container to remain in an upright position on its own. The semi-rigidity of the housing structure provides convenience for disposal rather than the flexible and collapsible construction of existing designs. In addition, such a structure for a disposable waste container eliminates the need to rely on secondary support structures for attachment to a toilet seat or bedpan in order to be held upright, such as using gatherings, snaps, strings, tabs, flanges or adhesives. Furthermore, a plurality of disposable waste containers, having a housing as structured above, may be nestable into a stacked configuration for easy packaging and storage. The invention provides a disposable waste container that is cost efficient to manufacture.

With regard to the foregoing description, it is to be understood that changes may be made in detail, especially in matters of the construction materials employed and the shape, size, and arrangement of the parts without departing from the scope of the present invention. It is intended that the specification and depicted embodiment be considered exemplary only, with a true scope and spirit of the invention being indicated by the broad meaning of the following claims.

I claim:

1. A disposable waste container for human bodily waste, comprising:

a housing adaptable for containing liquid and solid human bodily waste, said housing including a top, a bottom and a sidewall defining a reservoir within said housing; said top defining an open side adaptable for receiving liquid and solid human bodily waste;

said housing including a plurality of layers, said layers including at least an inner layer and an outer layer and at least one intermediate layer between said inner and outer layers, said layers are adjacently connected and disposed about said bottom and said sidewall extending to said top, said inner layer is a permeable structure that supports solid waste within said reservoir and enables liquid bodily waste to pass through to said intermediate layer, said intermediate layer is an absorbent material that receives and supports liquid bodily waste passed from said inner layer; said outer layer is an impermeable structure preventing any bodily waste to escape through said outer layer; and said housing is a self-supportable structure, wherein at least one of said layers is a semi-rigid layer that supports said sidewall to be maintained in an upright position.

2. The disposable waste container of claim 1, wherein said inner layer facing said reservoir.

3. The disposable waste container of claim 1, wherein said permeable structure being a porous material.

4. The disposable waste container of claim 1, wherein said outer layer facing an outer environment.

5. The disposable waste container of claim 1, wherein said impermeable structure being a plastic material.

6. The disposable waste container of claim 1, wherein said absorbent material being a semi-rigid structure, said semi-rigid structure enabling self-supporting of said housing.

7. The disposable waste container of claim 1, wherein said housing being adaptable for use with existing lavatory systems.

8. The disposable waste container of claim 1, wherein said housing being a stand-alone unit in an upright position for use as a lavatory system on its own.

9. The disposable waste container of claim 1, wherein said housing being a disposable unit after one time use.

10. The disposable waste container of claim 1, wherein said housing being a bucket shaped unit.

11. The disposable waste container of claim 1, wherein said housing being arranged and configured such that a plurality of said housings are nestable resembling a stacked configuration.

12. A lavatory system, comprising:

a disposable waste container including a housing adaptable for containing liquid and solid human bodily waste, said housing having a top, bottom and sidewall defining a reservoir within said housing and an open side adaptable for receiving liquid and solid human bodily waste, said housing including a plurality of connected layers, said layers including at least an inner layer and an outer layer and at least one intermediate layer between said inner and outer layers, said layers are adjacently connected and disposed about said bottom and said sidewall extending to said top, said inner layer is a permeable structure that supports solid waste within said reservoir and enables liquid bodily waste to pass through to said intermediate layer, said intermediate layer is an absorbent material that receives and supports liquid bodily waste passed from said inner layer; said outer layer is an impermeable structure preventing any bodily waste to escape through said outer layer, said housing is a self-supportable structure, wherein at least one of said layers is a semi-rigid layer that supports said sidewall to be maintained in an upright position;

a pan adaptable for holding said disposable waste container, wherein said disposable waste container being adaptable to a shape of said pan; and a toilet seat including a toilet housing adaptable for holding said pan having said disposable waste container held therein and for receiving waste into said disposable waste container, said toilet seat having a top surface connected with said toilet housing, said top surface enabling a user to sit on said toilet seat so as to void bodily waste from said user into said disposable waste container.

13. The disposable waste container of claim 1, wherein said layers are integrally formed as a one piece unit requiring no assembly.

* * * * *